US009073362B2

(12) United States Patent
Kremers et al.

(10) Patent No.: US 9,073,362 B2
(45) Date of Patent: Jul. 7, 2015

(54) INKJET PRINTER ASSEMBLY USING A GELLING UV CURABLE INK

(71) Applicant: Océ-Technologies B.V., Venlo (NL)

(72) Inventors: Martinus A. Kremers, Ottersum (NL); Anne A. Wind, Eindhoven (NL); Ronnie E. A. Blom, Linne (NL); Aswin Draad, Leur (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/458,331

(22) Filed: Aug. 13, 2014

(65) Prior Publication Data

US 2015/0062271 A1 Mar. 5, 2015

(30) Foreign Application Priority Data

Aug. 27, 2013 (EP) ..... 13181787

(51) Int. Cl.
*B41J 11/00* (2006.01)
*B41J 29/377* (2006.01)
*B41J 29/13* (2006.01)

(52) U.S. Cl.
CPC ..... *B41J 11/002* (2013.01); *B41J 29/13* (2013.01); *B41J 29/377* (2013.01)

(58) Field of Classification Search
CPC ..... B41J 11/002; B41J 11/0015; B41J 2/01; B41M 7/0072; C09D 11/101
See application file for complete search history.

(56) References Cited

U.S. PATENT DOCUMENTS 4,645,275 A 2/1987 Pucci
6,092,890 A * 7/2000 Wen et al. ..... 347/101
6,199,978 B1 3/2001 Ishii et al.
7,073,902 B2 * 7/2006 Codos et al. ..... 347/102
7,264,346 B2 * 9/2007 Nishino et al. ..... 347/102

FOREIGN PATENT DOCUMENTS

EP 0 414 371 A2 2/1991
JP 2004-51174 A 2/2004
JP 2007-98665 A 4/2007
WO WO 02/078958 A1 10/2002

* cited by examiner

*Primary Examiner* — Manish S Shah
*Assistant Examiner* — Jeremy Delozier
(74) *Attorney, Agent, or Firm* — Birch, Stewart, Kolasch & Birch, LLP

(57) ABSTRACT

An inkjet printer assembly for printing an image on a recording medium comprises a medium support surface for supporting a recording medium; an inkjet print head for ejecting droplets of an UV-curable ink on the recording medium, the inkjet print head being arranged over the medium support surface; an UV radiation source for irradiating the droplets of UV-curable ink on the recording medium, the UV radiation source being arranged over the medium support surface; a covering arranged over the medium support surface, the covering and the medium support surface together enclosing a print space including the inkjet print head and the UV radiation source; and exhaust means, the exhaust means being configured to vent the print space. The covering comprises a window part arranged such to allow a view on the medium support surface, the window part being at least partially transparent for visible light and configured to filter UV radiation from the UV radiation source to an extent that no harmful amount of UV radiation passes through. Thus, an operator is enabled to view a print result directly as it is printed without being subjected to harmful radiation.

11 Claims, 4 Drawing Sheets

INKJET PRINTER ASSEMBLY USING A GELLING UV CURABLE INK

FIELD OF THE INVENTION

The present invention generally pertains to an inkjet printer assembly using an UV-curable ink. Such inkjet printer assembly comprises an inkjet print head for ejecting droplets of the UV-curable ink and an UV radiation source for curing the ejected droplets of UV-curable ink.

BACKGROUND ART

Inkjet printers are well known in the art. Ink compositions that are curable by application of radiation, in particular UV radiation are also well known in the art. Such inkjet printers employing an UV-curable ink are typically used in professional printing (i.e. not for home or office use). In particular, the known UV-curable inkjet printer assemblies are common in the graphical arts printing industry.

In the professional printing industry, it is known and common to apply separate air ventilation systems to vent the space in which the printer assemblies are positioned.

During printing, curing of the ink results in emissions that have a typical, usually unpleasant smell. Moreover, depending on the particular ink composition and the emitted concentrations, the emissions may even be unhealthy. The ventilation systems remove the polluted air to an extent that the polluted air may not be unhealthy, but the smell remains.

JP2007098665 discloses an inkjet printer configured to eject UV-curable inkjet ink and cure the ink by application of UV radiation. In order to prevent emissions and odor, an adsorption means is provided inside a tightly closed print space. Thus, any emissions are prevented from entering the environment.

Further, UV radiation may be harmful to the human eye and skin. So, the printer assemblies known from the prior art have specific measures and features prevent that UV radiation is irradiated in another direction than towards the droplets of ink on a printed medium. However, usual radiation sources generate a relatively large amount of heat. Any measures and features for shielding of the UV radiation result in isolation and additional measures and features may be required to prevent overheating of the UV-radiation source. Moreover, in JP2007098665, the closed print space prevents cooling by convection. Additionally, any additional measures and features for protection against UV radiation limit the view on an image printed on the recording medium.

Despite all the above described technical limitations, the professional operator in the graphical arts is used to and prefers to be able to see the image print result as it is printed. Any artifacts and defects in the printed result should be identified as soon as possible such to be able to minimize unusable and therefore unsellable prints and such to enable to correct any incorrect print settings as soon as possible.

In an inkjet printer employing a gelling UV-curable ink, it may be advantageous to apply the UV radiation over a relatively large area having a predetermined radiation intensity profile. The ink is then suitably cured, but emissions may increase. Further, to prevent UV radiation becoming harmful, in such a printer, additional measures may be applied further limiting the view on the printed image. Even further, to prevent thermal de-gelling of the applied ink droplets, a temperature within the printer space should be kept suitably low.

It is desirable to have a printer assembly that is simple and cost effective, while addressing the above indicated technical limitations and operator desires.

SUMMARY OF THE INVENTION

In an aspect of the present invention, an inkjet printer assembly for printing an image on a recording medium is provided. The inkjet print assembly comprises a medium support surface for supporting a recording medium; an inkjet print head for ejecting droplets of a gelling UV-curable ink on the recording medium, the inkjet print head being arranged over the medium support surface and wherein the inkjet print head is configured to eject the gelling UV-curable ink at an elevated temperature, at which elevated temperature the ink is in a non-gelled state and the ink is configured to enter a gelled state on the recording medium; an UV radiation source for irradiating the droplets of UV-curable ink on the recording medium, the UV radiation source being arranged over the medium support surface; a covering arranged over the medium support surface, the covering and the medium support surface together enclosing a print space including the inkjet print head and the UV radiation source; and exhaust means, the exhaust means being configured to exhaust air from the print space. The covering comprises a window part arranged such to allow a view on the medium support surface, the window part being at least partially transparent for visible light and configured to filter UV radiation from the UV radiation source to an extent that no harmful amount of UV radiation passes through.

In the inkjet printer assembly according to the present invention, all desired aspects have been integrated into a cost-effective and simple arrangement. The inkjet printer assembly according to the present invention is a closed system, preventing polluted air to come into the print room and thus obviating the need for a separate ventilation system, thereby decreasing the overall costs related to the inkjet printer assembly. Further, the closed system prevents that an operator may come into contact with not yet cured ink. Despite the system being closed, the operator is enabled to view through the window part of the covering to look at the printed image as it is being printed, but without receiving a harmful amount of UV radiation due to the filtering of the UV radiation by the window part. Therefore, the UV radiation source does not require additional measures and features such as protective covering or the like, thereby decreasing the costs and providing a better view on the printed image. Moreover, while the UV radiation source may generate a relatively large amount of heat in the print space, due to the air flow having a cooling effect, the heat is effectively removed from the print space. Further, as there is no need for protective covering or cooling, more freedom of design is provided.

In an embodiment of the inkjet printer assembly, the inkjet print head is arranged on a print head carriage moveable in a scanning direction and the recording medium is moveable in a medium transport direction, the medium transport direction being substantially perpendicular to the scanning direction. The UV radiation source is arranged on a separate curing carriage, which curing carriage is moveable in the scanning direction.

In the known UV-curable inkjet printers, the UV radiation source is arranged on the print head carriage in order to cure the printed ink droplets as soon as possible such to prevent that a human operator or user is enabled to touch or come otherwise in contact with uncured ink. In the printer assembly according to the present invention, the printed ink droplets do not need to be cured immediately, as the print space is a closed space and an operator is not able to contact any just ejected droplets of ink. Therefore, a freedom of design is found in that a separate curing carriage may be provided, leaving the ejected ink droplets uncured for a predetermined amount of time. Such period of time may be advantageous for droplet spreading, for example, depending on properties of the ink and properties of the recording medium. Moreover, the cooling by generating an air flow and the UV radiation filtering cover enable to provide a UV radiation source that is smaller than the area being irradiated. Thus, a relatively large area may be irradiated with a predetermined radiation intensity profile to enable a suitable curing process of the ink having been applied on the recording medium.

In particular, the droplets of the gelling UV-curable ink are immobilized on the recording medium due to their gelling nature. In a gelled state, the ink droplets may be left uncured on the recording medium for a predetermined amount of time allowing improving any image quality aspects by suitable operations. Exemplary operations that cannot be applied with directly cured UV ink droplets include, but are not limited to, curing with aid of a specific UV radiation intensity profile for time-controlled curing and/or applying not yet cured droplets adjacent to or on top of previously applied droplets that may then coalesce or mingle to provide a smooth, high-gloss top surface.

In an advantageous embodiment, the separated curing carriage is configured to move simultaneously with the print head carriage. However, the curing carriage moves in opposite direction compared to the print head carriage. The moving masses, i.e. the mass of the print head carriage and the mass of the curing carriage, at least partly compensate each other's inertia forces, thereby decreasing any distorting movements of a frame of the printer assembly. Please note that in a particular embodiment, the curing carriage may be controlled to move, even when there is no curing to be performed, and likewise that the print head carriage may be moved, even when there is no printing to be performed. So, one of the two carriages may be moved just to compensate the inertia forces resulting from the movement of the other of the two carriages.

In an embodiment of the inkjet printer, the exhaust means comprise an air filter arranged and configured for filtering pollution from the air removed from the print space prior to being exhaust. Filtered air is of course in any case more environmental friendly, but may even be released into the printer room where the printer is located and the operator is present. The smell is substantially reduced after filtering and the filtered air is not hazardous to the operator. Suitable filters and other filtration means are well known in the art and may comprise active carbon filters, for example.

In another embodiment of the inkjet printer assembly, a ventilation means is provided and comprises an air conditioner arranged and configured for conditioning the air prior to being supplied to the print space. Using the air conditioner, possibly controlled in response to actual print space conditions as measured in the print space, the air supplied to the print space for venting the print space may be conditioned, e.g. may be cooled or its humidity may be controlled, thereby enabling to condition the print space for an optimal print quality control.

In a particular embodiment, considering that oxygen absorbs UV radiation and is therefore counterproductive in the curing process, an amount of oxygen in the air supplied is reduced or a gas is supplied instead of air, wherein the gas does not comprise oxygen. For example, nitrogen gas may be supplied. Moreover, after removal of pollution, nitrogen gas may be freely released into the atmosphere.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF THE DRAWINGS

Figure 1A:
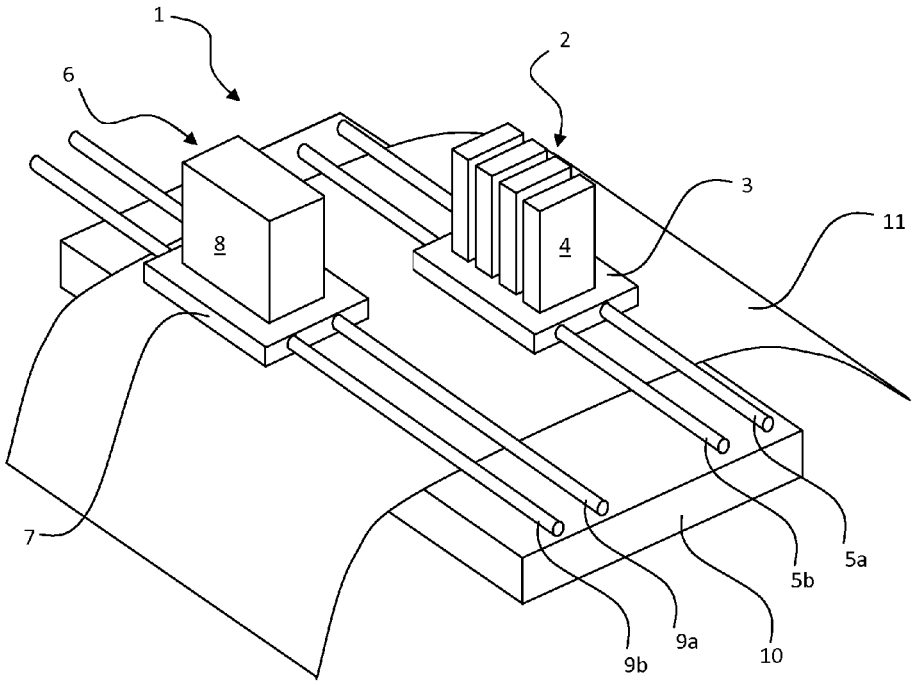
FIG. 1A schematically illustrates a scanning inkjet printer assembly in a perspective view.

The present invention will now be described with reference to the accompanying drawings, wherein the same reference numerals have been used to identify the same or similar elements throughout the several views.

Figure 1B:
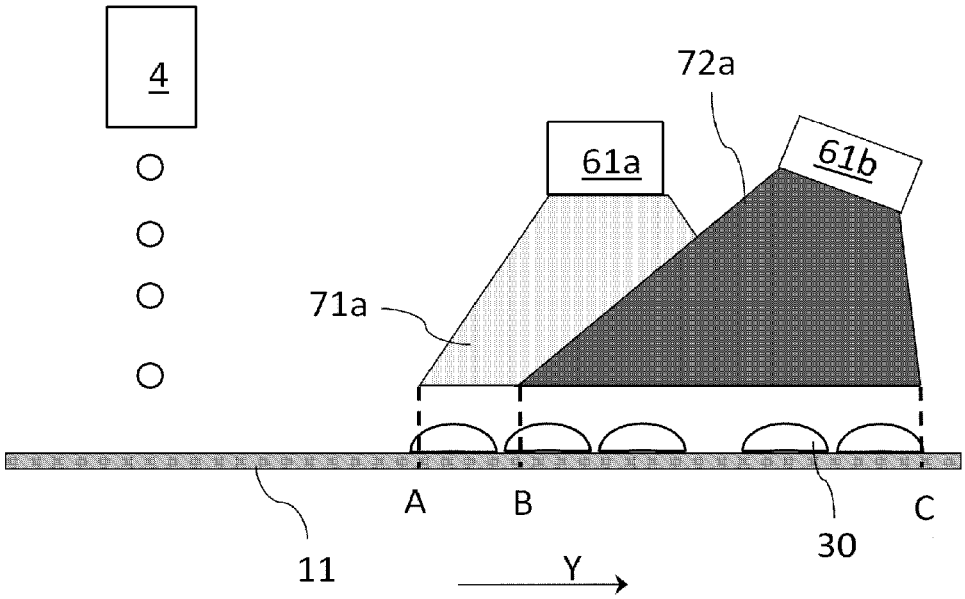
FIG. 1B schematically illustrates an exemplary embodiment of a curing unit for providing a predetermined UV radiation intensity profile.
Figure 1C:
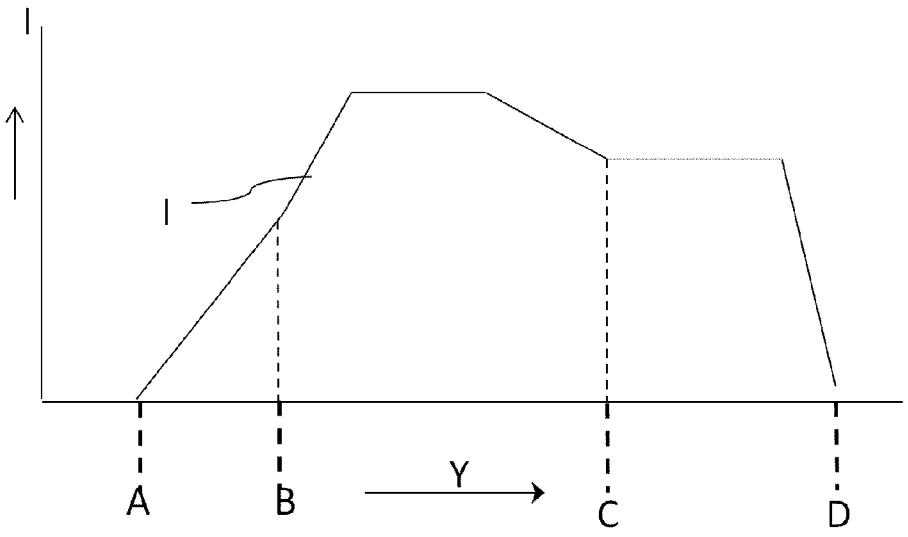
FIG. 1C illustrates an exemplary UV radiation intensity profile corresponding to the curing unit of FIG. 1B.

FIG. 1 shows an inkjet printer assembly 1 comprising a print unit 2 having a print head carriage 3 on which a number of print heads 4 is arranged. Commonly, for printing in full color, at least four print heads are present for printing in CMYK (Cyan, Magenta, Yellow and blacK), but any other number of print heads and/or different colors may be provided. The print head carriage 3 is movable over print head guide rails 5*a*, 5*b* in a scanning direction. A curing unit 6 has a curing carriage 7 carrying an UV radiation source 8. The curing carriage 7 is movable over curing guide rails 9*a*, 9*b* in the scanning direction.

In operation, in the illustrated printer assembly 1, the print head 4 is moved in the scanning direction and, while being moved, the print head 4 provides droplets of UV-curable ink image-wise on a recording medium 11 arranged on a medium support surface 10. The recording medium 11 is transported step-wise—when the print head 4 is not printing—in a transport direction, which is substantially perpendicular to the scanning direction. The ink remains uncured until the recording medium 11 is transported over such a distance that the droplets of ink on the recording medium 11 receive UV radiation from the UV radiation source 8.

In an embodiment, the print head 4 may be a page-wide print head or a page-wide array of print heads and/or the UV radiation source 8 may be page-wide such that one or both are not movably arranged, but are stationary and only the recording medium is transported in the transport direction relative to the print head 4 and/or the UV radiation source 8. Other arrangements of the print head, the UV radiation source and the recording medium, relative to each other, may as well be suitable and applicable for use with the present invention.

After ejection and before curing, the ejected droplets and the resulting dots on the recording medium 11 may be allowed to spread and coalesce. In an embodiment, such spreading and coalescence behavior is controlled by use of a gelling ink. Such gelling ink is composed and configured to enter a gelled state after having been applied on the recording medium. For example, the ink may have been heated to a temperature above room temperature and upon cooling on the recording medium 11, the ink may form a gel, immobilizing the dots of ink. Depending on the period of time needed to enter the gelled state, the ink is enabled to flow, spread and coalesce. Similarly, thixotropic behavior may be used to control spreading and coalescence of droplets (dots). Other rheologic behavior may as well be suitable and applicable for controlling the spreading and coalescence of applied droplets. It lies within the ambit of the person skilled in the art of designing an ink composition to select a suitable rheologic behavior and composing such ink using, for example, suitable rheology modifiers.

In the illustrated embodiment, the print head 4 is moved by the print head carriage 3 in the scanning direction to form a swath of ink dots on the recording medium 11. Multiple swaths may be arranged at least partly over each other and/or next to each other. The curing carriage 7 performs a movement similar to the print head carriage 3. The print head carriage 3 and the curing carriage 7 may be moved synchronously and simultaneously, but in opposing directions such to at least partly compensate for each other's inertia forces acting on the inkjet printer assembly 1. Smaller forces allow for a simpler and more cost-effective frame and/or decrease vibrations in the inkjet printer assembly 1, improving a resulting print quality.

Having a curing unit 6 and a print unit 2 separated from each other, the UV curable ink remains in a liquid state fore period of time. Such uncured UV curable ink may not be safe to be touched or otherwise contacted by an operator and, in any case, contact with the printed dots of such uncured, liquid UV curable ink results in diminished print quality. Therefore, it is preferred to have a printer assembly that prevents contact between an operator and the printed, but still liquid dots. On the other hand, these kinds of printer assemblies are usually for a professional print shop, where the operator wants and needs to verify that the print is being made with sufficient print quality. If there is a problem with the printer assembly or if print job settings are inaccurate, in any case, if the printed image is not good enough, the operator wants to identify such problem as soon as possible. So, the operator wants to be able to view the printed image as soon as it is being applied on the recording medium 11.

FIG. 1B schematically shows an exemplary embodiment of a curing unit 6. A first source of radiation 61*a* is provided, as well as a second source of radiation 61*b*. The first beam of radiation 71*a* emitted by the first source of radiation 61*a* is divergent; i.e. the diameter of the beam increases with increasing distance from the source of radiation 61*a*. Also the second beam 72*a* emitted by the second source of radiation 62*a* is divergent. The first beam 71*a* and the second beam 72*a* irradiate the recording medium 11 and any immobilized (e.g. gelled) droplets 30 deposited thereon. When the immobilized droplets 30 are moved in a transport direction Y, they are first irradiated by the first beam 71*a* at point A. Hence, at point A, (pre-)curing of the immobilized droplets 30 may start. When the droplets 30 applied on the recording medium 11 are moved further in the transport direction Y, they are first irradiated by the second beam 72*a* of radiation at point B. Hence, when the droplets 30 of ink pass point B, then (post-)curing of such droplets 30 may start. The droplets 30 of ink are irradiated by the second beam 72*a* until they pass point D.

A radiation intensity of the combined beams 71*a* and 72*a* at the surface of the recording medium 2 is not uniform. The intensity of the radiation provided by the first source of radiation 61*a* is strongest right underneath the source of radiation 61*a* and is lower at a position further removed from the source of radiation 61*a*. The intensity I of the first beam of radiation 71*a* at the various positions of the recording medium 11 is schematically depicted in FIG. 5B. The higher the intensity, the more energy is supplied to the ink.

In particular, at point A, the first beam 71*a* first contacts the recording medium 11. At this point, the intensity I of the first beam 71*a* is essentially 0. At a position further downstream, the intensity of the radiation of the first beam 71*a* is higher. This may result in increasing rates of (pre-)curing. Note that with curing, an amount of heat is generated in the droplets 30. The radiation intensity profile may therefore be selected to prevent that the immobilized droplets 30 are heated to a temperature at which they lose their gelled state before they are sufficiently immobilized due to curing. For example, at point B, the droplets 30 are still in the immobilized state and are partially cured in a pre-curing step.

At point B, the second beam 72*a* starts irradiating the droplets 30 applied onto the recording medium 11. The second beam 72*a* as depicted in FIG. 5A is a divergent beam. The second beam 72*a* is emitted by the second source of radiation 61*b*. By irradiating the droplets 30 using the second beam of radiation 72*a*, the droplets 30 are post-cured. By post-curing the droplets 30, the droplets 30 of ink may be completely cured and the layer of ink may be hardened.

In a position on the recording medium 11 downstream of point B, the droplets 30 may be irradiated by both the first beam 71*a* and the second beam 72*a* of radiation. Hence, when the droplets of ink 30 are irradiated by the second beam of radiation 72*a*, the ink may be post-cured.

As is shown in FIG. 5B, the intensity of the first beam of radiation 71*a* irradiating the recording medium 11 is not constant, but depends on the position on the recording medium 11.

In the illustrated embodiment (FIG. 5A), the second source of radiation 61*b* is in a tilted position. By tilting the source of radiation, the area of the recording medium 11 irradiated by the beam emitted by the source of radiation can be controlled. The skilled person will understand that the position of the second source of radiation 61*b* can be suitably selected to irradiate a selected area of the recording medium 11. However, due to the tilted position, the UV radiation is unprotected and thus becomes visible. To enable a suitable radiation intensity profile without limiting the freedom of design, in accordance with the present invention, a covering with a UV radiation filtering window part is provided.

Figure 2A:
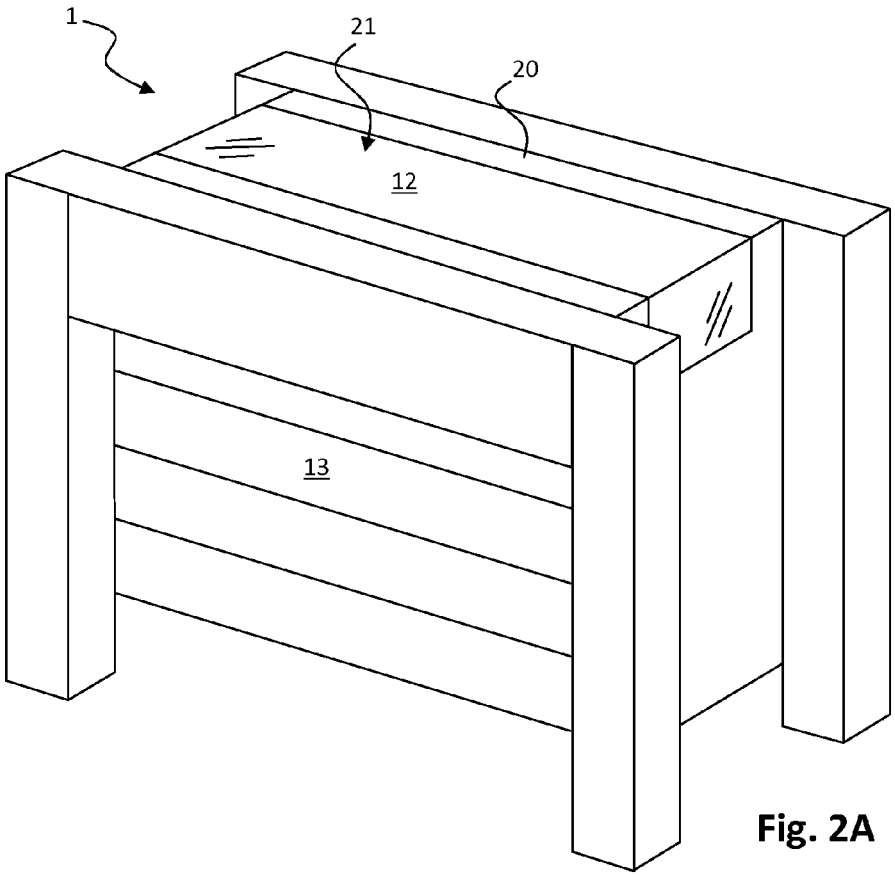
FIG. 2A shows a perspective view of an embodiment of an inkjet printer assembly according to the present invention.

In FIG. 2A, an exemplary embodiment of a printer assembly 1 according to the present invention is illustrated. The printer assembly 1 as shown is provided with a covering 20 protecting and covering the printer assembly 1 as shown in FIG. 1. The covering 20 and the medium support surface 10 (FIG. 1) together enclose a print space 21, in which the print unit 2 and the curing unit 6 operate. A window part 12 is provided on top to allow a view in the print space 21 and thus on the printed image as it is being printed.

The embodiment of the printer assembly 1 as illustrated herein is a roll-to-roll printing system, which means that the recording medium 11 is supplied from a roll and is wound onto a roll after having been printed on. The illustrated embodiment of the printer assembly 1 is provided at a front side with a recording medium delivery station 13, which comprises a delivery roll on which the printed recording medium 11 is wound. In particular, in the illustrated embodiment, the delivery station 13 comprises a drawer in which the delivery roll is provided. It is noted that for practicing the present invention, the printer assembly 1 does not need to be a roll-to-roll printer but may as well be a printer assembly printing on sheets or on a recording medium supplied from a roll and cut by the printer assembly into sheets during printing.

The UV radiation generated by the UV radiation source 8 is usually harmful for the human eye and skin. Therefore, in the prior art, the UV radiation source 8 is shielded to prevent that a substantial amount of radiation, i.e. an amount that may harm the human eye, may become visible. The provided shielding results in diminished visibility of the printed image. In the present invention, the window part 12 is suited to filter the radiation passing through the window part 12. In particular, the window part 12 may filter and remove the UV radiation from the radiation passing through, while allowing visible light to pass. As a consequence, there is no need for specific shielding of the UV radiation source, thereby allowing an improved view on the printed image. Hence, an operator may have an improved view of the printed image without a risk of being harmed by UV radiation.

The window part 12 may be made from a suitable material such as polycarbonate, for example, that suitably filters the UV radiation, while allowing sufficient visible light. Other suitable materials are deemed to be available and well known to the skilled person. Further, any other transparent material may be applied and be provided with a suitable filtering coating or foil like material, which coating or foil like material filters the UV radiation from the radiation.

Figure 2B:
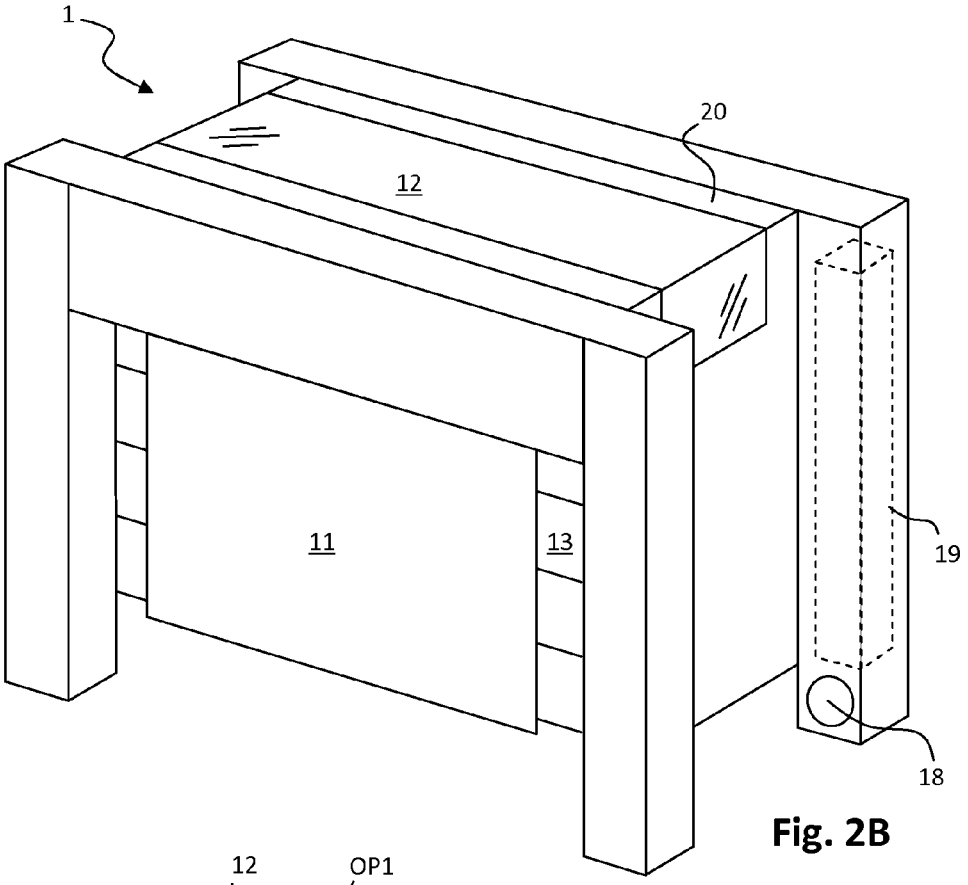
FIG. 2B shows a perspective view of the embodiment according to FIG. 2A in operation.

FIG. 2B illustrates the embodiment according to FIG. 2A in operation. A printed recording medium 11 is supplied from the print space 21 to the delivery station 13. However, instead of feeding the recording medium 11 directly to the delivery station 13, where the printed image is not visible anymore as it is wound on a roll, the recording medium 11 is first fed along the front side past the delivery station 13 and is only then fed to the delivery roll of the delivery station. Thus, an operator is enabled to review the printed image before it is wound on the delivery roll. Moreover, in a professional environment, an operator may be operating a large number of printers. Feeding the recording medium 11 after having been printed on along a front side of the printer assembly 1 allows the operator to see the printed image from a distance, while operating another printer assembly. Thus, without spending time to specifically inspect each and every printer once in a while, the operator is now enabled to constantly see the printed image and detect any print problems as soon as they occur.

While curing the ink, volatile substances may be released into the surrounding air. Such substances may have a bad smell or, depending on the specific ink composition, may even be unhealthy. To prevent the operator from coming into contact with too much of such volatile substances, it is common practice to provide a dedicated ventilation system in the room where an UV-curing printing system is placed. Such ventilation system is usually expensive and may need structural adaptations to the building. Therefore, purchase of such a printing system may become substantially more expensive than the costs for the printing system alone.

In the printer assembly 1 according to the present invention, the print space 21 where the volatile substances are released is a closed space. The print space 21 is vented by an exhaust system. In FIG. 2B, an exemplary exhaust opening 18 is illustrated to be positioned near a support surface e.g. a floor. A first end of a simple exhaust tube may be connected to the exhaust opening 18. The other end of the exhaust tube may be arranged in the outside air, thereby preventing that volatile substances are released into the room.

The actual exhaust system may be integrated into the printer assembly 1 as shown in FIG. 2B, but may as well be positioned in a separate casing and connected to the exhaust opening 18 of the printer assembly 1 by suitable tubing.

Depending on the requirements and the volatile substances released, an air filter system 19 may be provided in the printer assembly 1 (or in a separate casing, as above suggested in relation to the exhaust system). Such air filter system 19 may be designed and configured to remove certain or all polluting volatile substances from the air flow. A suitable air filter system 19 in combination with a suitable ink composition could provide for an exhaust opening 18 from which only clean air is released. In such embodiment, no further tubing would be needed and the cleaned air could be released into the room. Apart from venting the print space 21 and removing any polluting volatile substances, the air flow from the exhaust system provides an additional advantage of cooling the print unit 2 and the curing unit 6. In particular, the UV radiation source 8 may generate quite some heat. In a closed system such amount of generated heat should be suitably removed. The exhaust system provides for such removal of heat, alleviating the requirements for elements to be provided on the curing carriage 7, for example, and thus allowing for more freedom of design.

Figure 2C:
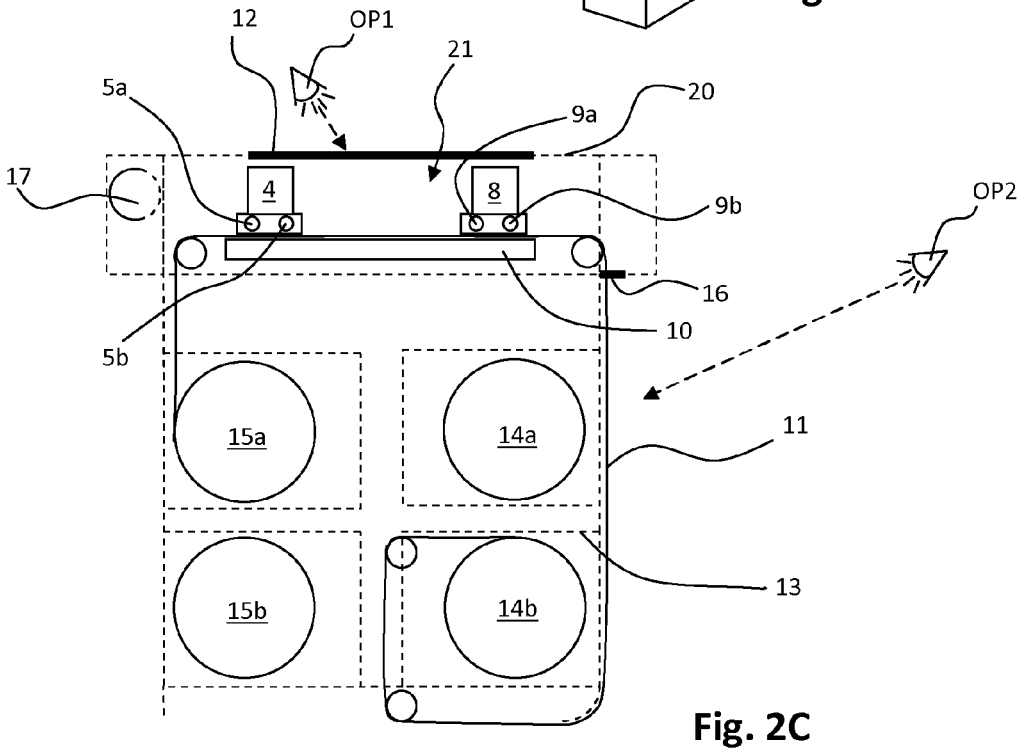
FIG. 2C schematically illustrates a cross-section of the embodiment according to FIG. 2A.

In FIG. 2C, a schematic cross-section of the embodiment of the printer assembly 1 according to FIGS. 2A and 2B is shown. The covering 20 is shown with a dashed line, encompassing the print space 21, which is further delimited by the medium support surface 10. In the print space 21, the print head 4 and the UV radiation source 8 are arranged, each movably arranged on their respective guide rails 5*a*, 5*b*, 9*a* and 9*b*. Over the print space 21, the window part 12 is provided allowing an operator to view the printed image from a first operator position OP1.

The recording medium 11 is supplied from a supply roll 15*a*. In the illustrated embodiment a further supply roll 15*b* is provided. Such further supply roll 15*b* may provide for another kind of recording medium 11 or for a second roll of the same kind of recording medium 11, allowing for longer unattended printing of a large print job, for example.

In the illustrated embodiment, the print engine is arranged at a first end (top) of the printer assembly 1, while the recording medium 11 is fed to the delivery station 13 at a second end (bottom) of the printer assembly 1. In particular, the recording medium 11 is transported over the medium support surface 10 along the print head 4 and the UV radiation source 8. After curing, the printed image is dry and suited for directly being wound onto a delivery roll. However, in the illustrated embodiment, the recording medium 11 is transported from the medium support surface 10, through a print space exit opening 16 along the front side of the printer assembly 1. Thus, the operator is enabled to view the printed image from a second operator position OP2, as above described.

The recording medium 11 is then transported towards a bottom surface of the printer assembly 1 and through the bottom into the delivery station 13 and onto the delivery roll 14*b*. A further delivery roll 14*a* is also provided in the illustrated embodiment, which provides additional functionality, but is not required, like the further supply roll 15*b*.

A venting tube 17 is provided and arranged such that air and any polluting substances therein may be sucked from the print space 21 and transported to the exhaust opening 18 (FIG. 2B), possibly through the filter system 19. In this embodiment, due to the suction of air from the print space 21, an air flow through the print space exit opening 16 to the print space 21 may be expected. Such air flow prevents the release of polluting substances through the print space exit opening 16.

In another embodiment, the air flow into the print space 21 may be controlled to provide for a conditioned air to flow into the print space 21. For example, the temperature and/or the humidity of the incoming air may be controlled. In such embodiment, additional measures may be preferred to prevent air flowing into the room through the print space exit opening 16. Suitable measures to prevent such flow of air are well known in the art and are not described in further detail here.

Figure 2D:
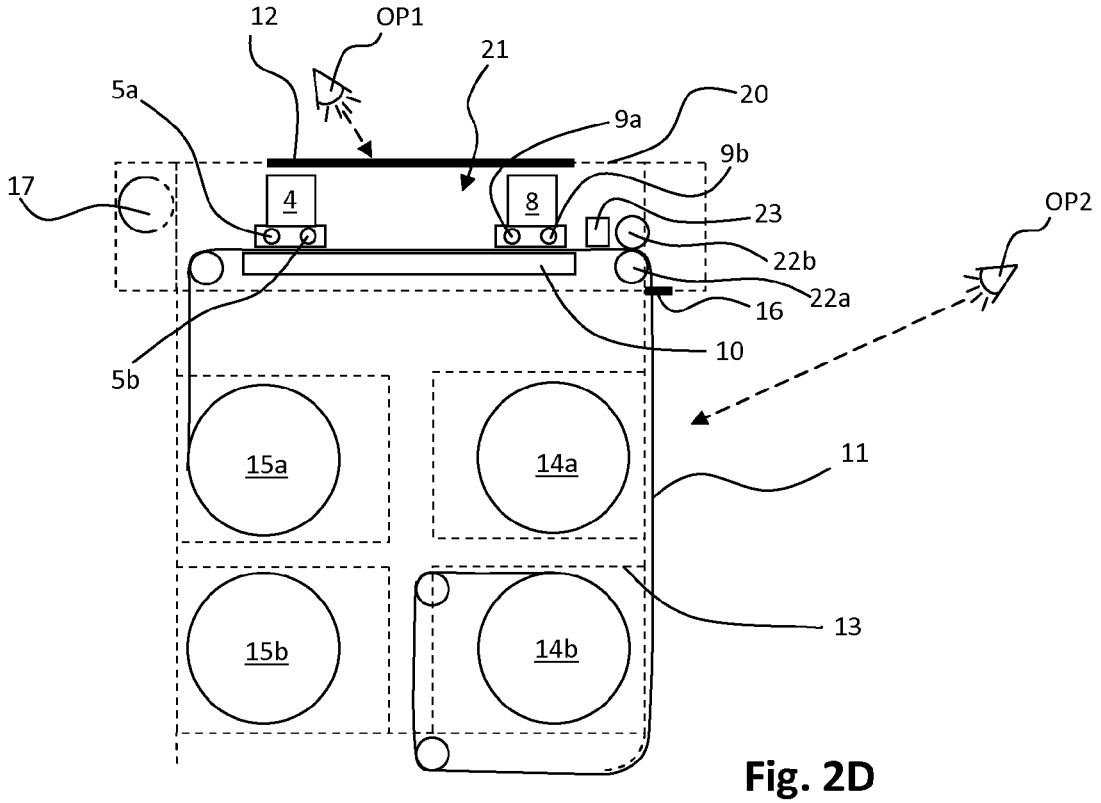
FIG. 2D schematically states a cross-section of a further embodiment according to FIGS. 2A and 2C.

In FIG. 2D, an embodiment according to FIG. 2C is illustrated. In the embodiment of FIG. 2D in addition to the embodiment of FIG. 2C, in the print space 21, upstream of the print space exit opening 16 and downstream of the print engine, a transport nip formed by a first nip roller 22*a* and a second nip roller 22*b* is provided. The transport nip is configured and arranged to guide the recording medium 11 towards the delivery station 13. Further, a detector 23, in particular an end of recording medium detection unit, is provided for detecting a trailing edge of the recording medium 11. In the illustrated embodiment, the detector 23 is arranged directly upstream of the transport nip; in practice the detector 23 may be arranged at any position between the supply roll 15*a* or 15*b* and the transport nip and in any case preferably upstream of the print engine. When the detector 23 detects a trailing edge of the recording medium 11, the printer assembly 1 is configured to proceed with printing until the trailing edge reaches the transport nip. The transport nip holds the trailing edge preventing that the trailing edge passes through the print space exit opening 16 upon which the trailing edge would fall onto the floor, thereby potentially damaging or dirtying the recording medium 11 with the recorded image. The operator will then be enabled to guide the trailing edge onto the delivery roll.

While detailed embodiments of the present invention are disclosed herein, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An inkjet printer assembly for printing an image on a recording medium, the inkjet printer assembly comprising:

a medium support surface for supporting a recording medium;

an inkjet print head for ejecting droplets of a gelling UV-curable ink on the recording medium, the inkjet print head being arranged over the medium support surface and wherein the inkjet print head is configured to eject the gelling UV-curable ink at an elevated temperature, at which elevated temperature the ink is in a non-gelled state and the ink is configured to enter a gelled state on the recording medium;

an UV radiation source for irradiating the droplets of UV-curable ink on the recording medium, the UV radiation source being arranged over the medium support surface;

a covering arranged over the medium support surface, the covering and the medium support surface together enclosing a print space including the inkjet print head and the UV radiation source; and an exhaust device configured to exhaust air from the print space;

wherein the covering comprises a window part arranged such to allow a view on the medium support surface, the window part being at least partially transparent for visible light and configured to filter UV radiation from the UV radiation source to an extent that no harmful amount of UV radiation passes through.

2. The inkjet printer assembly according to claim 1, wherein the inkjet print head is arranged on a print head carriage moveable in a scanning direction and the recording medium is moveable in a medium transport direction, the medium transport direction being substantially perpendicular to the scanning direction and wherein the UV radiation source is arranged on a curing carriage, which curing carriage is moveable in the scanning direction.

3. The inkjet printer assembly according to claim 2, wherein the print head carriage and the curing carriage are configured to move simultaneously in opposite direction.

4. The inkjet printer assembly according to claim 1, wherein the exhaust device is provided with an air filter for filtering pollution from the air removed from the print space prior to being exhaust.

5. The inkjet printer assembly according to claim 1, wherein a ventilation means is provided and comprises an air conditioner for conditioning the air prior to being supplied to the print space.

6. The inkjet printer assembly according to claim 1, wherein the printer assembly comprises a medium supply station configured to supply a web of the recording medium from a supply roll;

a delivery station configured to wind the web of the recording medium on a delivery roll, and an assembly enclosure enclosing at least the medium support surface, the inkjet print head, the UV radiation source and the delivery station;

wherein the printer assembly is configured to feed the recording medium from the medium support surface to the delivery station beside and outside the assembly enclosure, the print side of the recording medium facing away from the printer assembly.

7. The inkjet printer assembly according to claim 6, wherein the medium support surface is arranged at a first side of the delivery station, and the printer assembly is configured to feed the recording medium to the delivery station at a second side of the delivery station, the second side being different from the first side.

8. The inkjet printer assembly according to claim 7, wherein the printer assembly is configured to feed the recording medium past the delivery station prior to feeding the recording medium to the delivery station.

9. The inkjet printer assembly according to claim 7, wherein the second side is opposite to the first side.

10. The inkjet printer assembly according to claim 9, wherein the assembly enclosure extends from a first end to a second end and wherein the print space is arranged at the first end of the assembly enclosure and the second side of the delivery station is arranged at the second end of the assembly enclosure.

11. The inkjet printer assembly according to claim 6, wherein the printer assembly is provided with an end of recording medium detection unit, the detection unit being configured to detect a trailing edge of the recording medium, and wherein upon detection of the trailing edge the printer assembly is configured to hold the trailing edge at the print engine.

* * * * *